US008200303B2

(12) United States Patent
Morishita

(10) Patent No.: US 8,200,303 B2
(45) Date of Patent: Jun. 12, 2012

(54) PORTABLE TERMINAL ANTENNA ARRANGEMENT TO SUPPRESS DETERIORATION OF ANTENNA SENSITIVITY

(75) Inventor: Katsuji Morishita, Kanagawa (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 13/265,397

(22) PCT Filed: Apr. 23, 2010

(86) PCT No.: PCT/JP2010/057221

§ 371 (c)(1),
(2), (4) Date: Oct. 20, 2011

(87) PCT Pub. No.: WO2010/123092

PCT Pub. Date: Oct. 28, 2010

(65) Prior Publication Data

US 2012/0040726 A1 Feb. 16, 2012

(30) Foreign Application Priority Data

Apr. 24, 2009 (JP) ..... 2009-107183

(51) Int. Cl.
*H04M 1/00* (2006.01)

(52) U.S. Cl. ..... 455/575.7; 455/550.1; 455/575.3; 343/893

(58) Field of Classification Search ..... 455/575.5, 455/575.3, 575.1, 575.7; 343/893
See application file for complete search history.

(56) References Cited

U.S. PATENT DOCUMENTS

| | | | | |
|---|---|---|---|---|
| 6,728,559 | B2 * | 4/2004 | Masaki | 455/575.5 |
| 2009/0170570 | A1 * | 7/2009 | Uejima et al. | 455/575.3 |
| 2010/0285851 | A1 * | 11/2010 | Horihata et al. | 455/575.3 |

FOREIGN PATENT DOCUMENTS

| | | | |
|---|---|---|---|
| JP | 2006-166225 | A | 6/2006 |
| JP | 2007-74366 | A | 3/2007 |
| JP | 2007-104468 | A | 4/2007 |
| JP | 2008-177730 | A | 7/2008 |

OTHER PUBLICATIONS

International Search Report for PCT/JP2010/057221, mailed Jul. 27, 2010.

* cited by examiner

*Primary Examiner* — Vladimir Magloire
(74) *Attorney, Agent, or Firm* — Hoffmann & Baron, LLP

(57) ABSTRACT

Provided is a portable terminal which is provided with a first case, a second case, and a connecting section which connects together the first case and the second case, and has less deterioration of antenna sensitivity. The portable terminal has the first case (2), the second case (3), the connecting section (4), a first circuit section (32) disposed in the first case (2), a first conductive section (31) disposed in the first case (2), a second conductive section (33) disposed in the second case (3), a third conductive section (34) disposed in the connecting section (4), and a first electronic component (61) disposed adjacent to the first conductive section (31) in the length direction of the first case (2) in the first case (2). The first length (X1), which is obtained from the sum of the path length of the signals in the band of a first frequency (f1) in the first conductive section (31) and the path length of the signals in the band of the first frequency (f1) in the first electronic component (61), is substantially the same as the second length (X2), which is obtained from the sum of the path length of the signals in the band of the first frequency (f1) in the second conductive section (33) and the path length of the signals in the band of the first frequency (f1) in the third conducive section (34).

10 Claims, 7 Drawing Sheets

PORTABLE TERMINAL ANTENNA ARRANGEMENT TO SUPPRESS DETERIORATION OF ANTENNA SENSITIVITY

CROSS-REFERENCE TO RELATED APPLICATIONS:

This application is the National Stage of International Application No. PCT/JP2010/057221, filed Apr. 23, 2010, which claims the benefit of Japanese Application No. 2009-107183, filed Apr. 24, 2009, the entire contents of both of which are incorporated by reference herein.

FIELD OF THE INVENTION

The present invention relates to a mobile terminal device such as a cellular telephone device.

BACKGROUND OF THE INVENTION

Conventionally, as a mobile terminal device, a cellular telephone device of a folder type has been known, which includes a first body, a second body, and a connecting portion connecting the first body and the second body, and which is configured so as to be capable of transitioning to an opened state and a closed state via the connecting portion depending on the usage aspects. A cellular telephone device of such a folder type has a communication function to perform communication externally via an antenna.

For example, Patent Document 1 proposes a cellular telephone device, in which one of a first conductive portion disposed in the first body and a second conductive portion disposed in the second body can be utilized as an antenna, by feeding power to one of the first conductive portion and the second conductive portion and by grounding the other one (in a ground state).

Patent Document 1: Japanese Unexamined Patent Application, Publication No. 2007-104468

SUMMARY OF THE INVENTION

Problems to be Solved by the Invention

However, in the cellular telephone device proposed in Patent Document 1, a connecting portion is disposed between the first body and the second body. Accordingly, a third conductive portion disposed in the connecting portion also functions as a part of the antenna or a part of the ground.

Accordingly, in a cellular telephone device in which a length of the first conductive portion in the first body is substantially identical to a length of the second conductive portion in the second body, for example, the length of the first conductive portion in the first body is different from a length obtained by summation of the length of the second conductive portion in the second body and a length of a third conductive portion in the connecting portion. In this case, the electrical length of the ground and the electrical length of the antenna are not balanced. Accordingly, this brings about a problem of deteriorating the antenna sensitivity.

In a mobile terminal device including a first body, a second body, and a connecting portion connecting the first body and the second body, an object of the present invention is to provide a mobile terminal device that suppresses deterioration of the antenna sensitivity.

Means for Solving the Problems

The present invention relates to a mobile terminal device, including: a first body; a second body; a connecting portion that connects the first body and the second body; a first circuit unit that is disposed in the first body, and includes a ground unit, a power feed unit and a signal processing unit that is connected to the power feed unit and processes a signal in a first frequency band; a first conductive portion that is disposed in the first body, and is connected to one of the ground unit or the power feed unit; a second conductive portion that is disposed in the second body; a third conductive portion that is disposed in the connecting portion, and is connected to the second conductive portion and the other one of the ground unit or the power feed unit; and a first electronic component that is disposed adjacently to the first conductive portion in the first body, and is connected at high frequency to the first conductive portion, in which a first length, which is obtained by summation of a path length of a signal in the first frequency band in the first conductive portion and a path length of a signal in the first frequency band in the first electronic component, is substantially identical to a second length, which is obtained by summation of a path length of a signal in the first frequency band in the second conductive portion and a path length of a signal in the first frequency band in the third conductive portion.

Moreover, it is preferable that the first conductive portion is connected to the ground unit; the third conductive portion is connected to the power feed unit; the first length is a path length of a signal in the first frequency band from a contact point, where the first conductive portion is in contact with the ground unit, to the first electronic component; and the second length is a path length of a signal in the first frequency band from a contact point, where the third conductive portion is in contact with the power feed unit, to the second conductive portion.

In addition, it is preferable that the first conductive portion is formed so as to be elongated in a longitudinal direction of the first body; the second conductive portion is formed so as to be elongated in a longitudinal direction of the second body; the first electronic component is formed so as to be elongated in a width direction that is orthogonal to the longitudinal direction of the first body; and one end of the first electronic component in the width direction is connected to the first conductive portion.

Furthermore, it is preferable that the first electronic component is an antenna element resonating with a signal in a second frequency band, and the mobile terminal device further includes: a second circuit unit that is connected to the first electronic component, and processes a signal in the second frequency band resonated by the first electronic component; a first suppression unit that is disposed so as to be interposed between the first conductive portion and the first electronic component, and suppresses passage of a signal in a frequency band different from the first frequency band; and a second suppression unit that is disposed so as to be interposed between the first electronic component and the second circuit unit, and suppresses passage of a signal in a frequency band different from the second frequency band.

Moreover, it is preferable that the mobile terminal device further includes: a second electronic component that is disposed adjacently to the second conductive portion in the longitudinal direction of the second body in the second body, and is connected at high frequency to the second conductive portion, a first selection unit that is configured so as to be capable of selecting a state where the first conductive portion and the first electronic component are connected at high frequency, or a state where the first conductive portion and the first electronic component are cut off at high frequency; a second selection unit that is configured so as to be capable of selecting a state where the second conductive portion and the second electronic component are connected at high frequency, or a state where the second conductive portion and the second electronic component are cut off at high frequency; and a control unit that controls connection or cutoff of the first selection unit, and connection or cutoff of the second selection unit.

In addition, the present invention relates to a mobile terminal device, including: a first body; a second body; a connecting portion that connects the first body and the second body; a first circuit unit that is disposed in the first body, and includes a ground unit, a power feed unit and a signal processing unit that is connected to the power feed unit and processes a signal in a first frequency band; a first conductive portion that is disposed in the first body, and is connected to one of the ground unit or the power feed unit; a second conductive portion that is disposed in the second body; a third conductive portion that is disposed in the connecting portion, and is connected to the second conductive portion and the other one of the ground unit or the power feed unit; and a first electronic component that is disposed adjacently to the first conductive portion in the longitudinal direction of the first body in the first body, and is connected at high frequency to the first conductive portion; and a second electronic component that is disposed adjacently to the second conductive portion in the longitudinal direction of the second body in the second body, and is connected at high frequency to the second conductive portion, in which a third length, which is a path length of a signal in the first frequency band in the first conductive portion, is substantially identical to a fourth length, which is obtained by summation of a path length of a signal in the first frequency band in the second conductive portion and a path length of a signal in the first frequency band in the third conductive portion; and a fifth length, which is obtained by summation of the third length and a length along a longitudinal direction of the first electronic component, is substantially identical to a sixth length, which is obtained by summation of the fourth length and a length along a longitudinal direction of the second electronic component.

Furthermore, it is preferable that the first conductive portion is connected to the ground unit; the third conductive portion is connected to the power feed unit; the third length is a path length of a signal in the first frequency band from a contact point, where the first conductive portion is in contact with the ground unit, to a contact point, where the first conductive portion is in contact with the first electronic component; the fourth length is a path length of a signal in the first frequency band from a contact point, where the third conductive portion is in contact with the power feed unit, to the second conductive portion; the fifth length is a path length of a signal in the first frequency band from a contact point, where the first conductive portion is in contact with the ground unit, to the first electronic component; and the sixth length is a path length of a signal in the first frequency band from a contact point, where the third conductive portion is in contact with the power feed unit, to the second electronic component.

Moreover, it is preferable that the first conductive portion is formed so as to be elongated in a longitudinal direction of the first body; the second conductive portion is formed so as to be elongated in a longitudinal direction of the second body; the first electronic component is formed so as to be elongated in a width direction that is orthogonal to the longitudinal direction of the first body, and one end of the first electronic component in the width direction of the first body is connected to the first conductive portion; and the second electronic component is formed so as to be elongated in a width direction that is orthogonal to the longitudinal direction of the second body, and one end of the second electronic component in the width direction of the second body is connected to the second conductive portion.

In addition, it is preferable that the first electronic component is an antenna element resonating with a signal in a second frequency band, and the mobile terminal device further includes: a second circuit unit that is connected to the first electronic component, and processes a signal in the second frequency band resonated by the first electronic component; a first suppression unit that is disposed so as to be interposed between the first conductive portion and the first electronic component, and suppresses passage of a signal in a frequency band different from the first frequency band; and a second suppression unit that is disposed so as to be interposed between the first electronic component and the second circuit unit, and suppresses passage of a signal in a frequency band different from the second frequency band.

Furthermore, it is preferable that the mobile terminal device further includes: a first selection unit that is configured so as to be capable of selecting a state where the first conductive portion and the first electronic component are connected at high frequency, or a state where the first conductive portion and the first electronic component are cut off at high frequency; a second selection unit that is configured so as to be capable of selecting a state where the second conductive portion and the second electronic component are connected at high frequency, or a state where the second conductive portion and the second electronic component are cut off at high frequency; and a control unit that controls connection or cutoff of the first selection unit, and connection or cutoff of the second selection unit.

Effects of the Invention

According to the present invention, in a mobile terminal device including a first body, a second body, and a connecting portion connecting the first body and the second body, it is possible to provide a mobile terminal device that suppresses deterioration of the antenna sensitivity.

EXPLANATION OF REFERENCE NUMERALS

Figure 1:
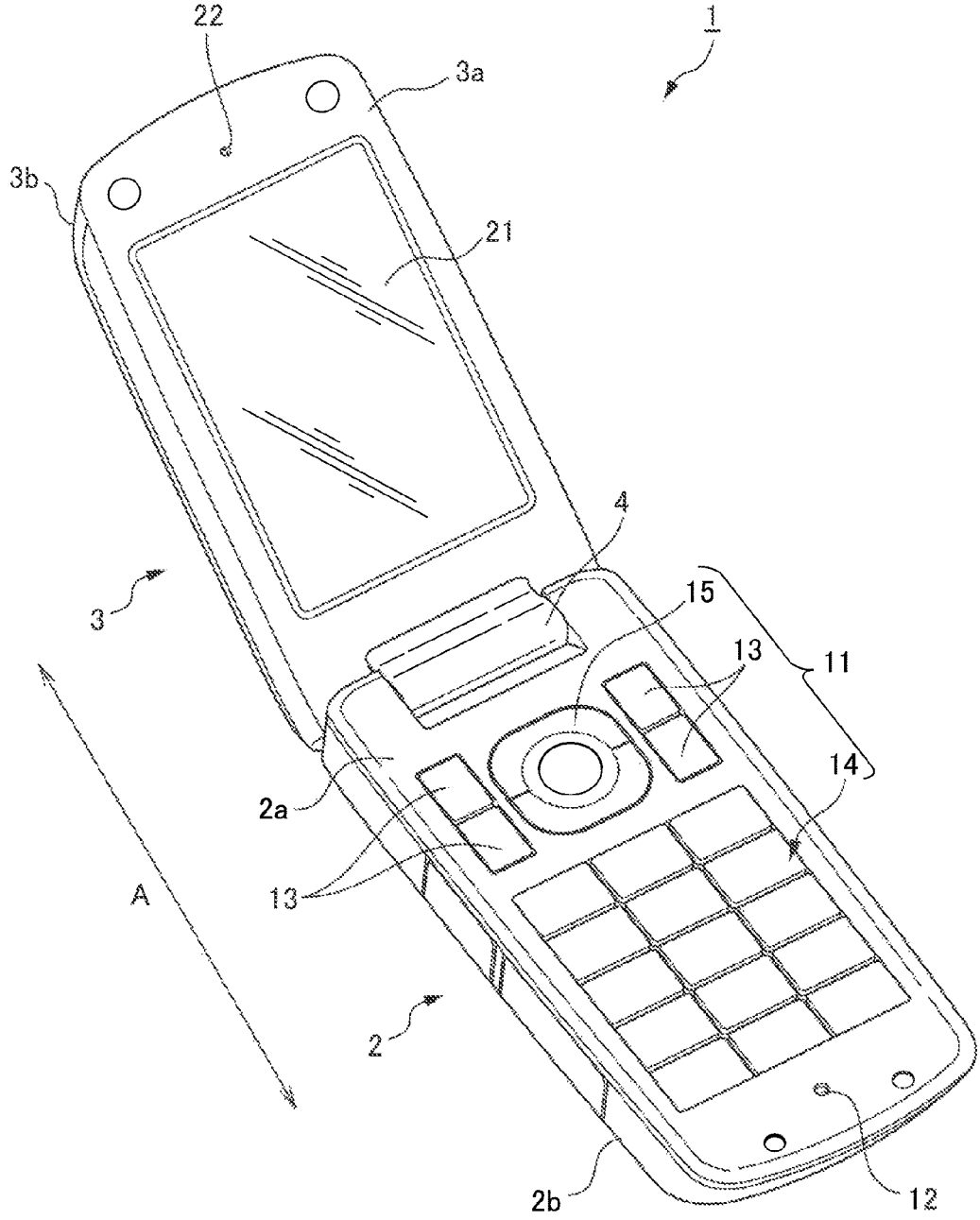
FIG. 1 is a perspective view showing an appearance of a cellular telephone device according to the present invention in an opened state.

1 cellular telephone device (mobile terminal device)
2 operation unit side body (first body)
3 display unit side body (second body)
4 connecting portion
22 receiver (second electronic component)

31 first conductive portion
32 first circuit unit
33 second conductive portion
34 third conductive portion
35 ground unit
36 power feed unit
37 signal processing unit
42 first suppression unit
43 second suppression unit
51 first selection unit
52 second selection unit
61 antenna element (first electronic component)
X1 first length
X2 second length
f1 first frequency
f2 second frequency

DETAILED DESCRIPTION OF THE INVENTION

Descriptions are provided hereinafter regarding an embodiment of the present invention with reference to the drawings. A basic structure of a cellular telephone device 1 as a mobile terminal device according to a first embodiment is described with reference to FIG. 1. FIG. 1 is a perspective view showing an appearance of the cellular telephone device 1 in an opened state.

As shown in FIG. 1, the cellular telephone device 1 as a mobile terminal device includes: an operation unit side body 2 as a first body shaped like a substantially rectangular parallelepiped; and a display unit side body 3 as a second body shaped like a substantially rectangular parallelepiped. Each of the operation unit side body 2 and the display unit side body 3 has a shape elongated in a longitudinal direction A.

The operation unit side body 2 and the display unit side body 3 are connected so as to be openable and closable via a connecting portion 4 including a hinge mechanism. More specifically, an upper end portion of the operation unit side body 2 and a lower end portion of the display unit side body 3 are connected via the connecting portion 4. As a result, the cellular telephone device 1 is configured so as to be capable of forming opened/closed states by relatively moving the operation unit side body 2 and the display unit side body 3 connected via the hinge mechanism.

In other words, the cellular telephone device 1 can be arranged into an opened state where the operation unit side body 2 and the display unit side body 3 are apart from each other, and into a folded state where the operation unit side body 2 and the display unit side body 3 are contacting each other, by relatively rotating (pivoting) the operation unit side body 2 and the display unit side body 3, which are connected via the connecting portion 4.

An outer surface of the operation unit side body 2 is configured with a front case 2*a* and a rear case 2*b*. An operation key set 11 and a microphone 12 are each exposed on the front case 2*a* side of the operation unit side body 2, in which the microphone 12 serves as a sound input unit to which sound produced by a user of the cellular telephone device 1 during a phone call is input.

The operation key set 11 is configured with: function setting operation keys 13 for operating various functions such as for various settings, a telephone number directory function and a mail function; input operation keys 14 for inputting the digits of a telephone number, characters for mail, and the like; and a selection operation key 15 for performing selection of the various operations, scrolling up, down, left and right, etc. Predetermined functions are assigned (key assignment) to each key configuring the operation key set 11 in accordance with the opened/closed state of the operation unit side body 2 and the display unit side body 3, various modes, and the type of application that is running. An operation corresponding to a function assigned to each key is executed by the user depressing each key.

The microphone 12 is disposed to an outer end side (lower end side) that is opposite to the connecting portion 4 side in the longitudinal direction A of the operation unit side body 2. In other words, the microphone 12 is disposed to one outer end side of the cellular telephone device 1 in the opened state.

An interface (not illustrated) for communicating with an external device (for example, a host device) is disposed on one side face of the operation unit side body 2. Side keys, to which predetermined functions are assigned, and an interface (not illustrated), where external memory is inserted and removed, are disposed on another side face of the operation unit side body 2. When not in use, each interface is covered with a cap.

An outer surface of the display unit side body 3 is configured with a front case 3*a* and a rear case 3*b*. On the front case 3*a* of the display unit side body 3, a display unit 21 for displaying a variety of information, and a receiver 22 that outputs sound of the other party of a phone call are disposed so as to be exposed to the outside. Here, the display unit 21 is configured with a liquid crystal display panel, a drive circuit that drives the liquid crystal display panel, a light source unit such as a backlight that irradiates light from the back face side of the liquid crystal display panel, etc.

Figure 2:
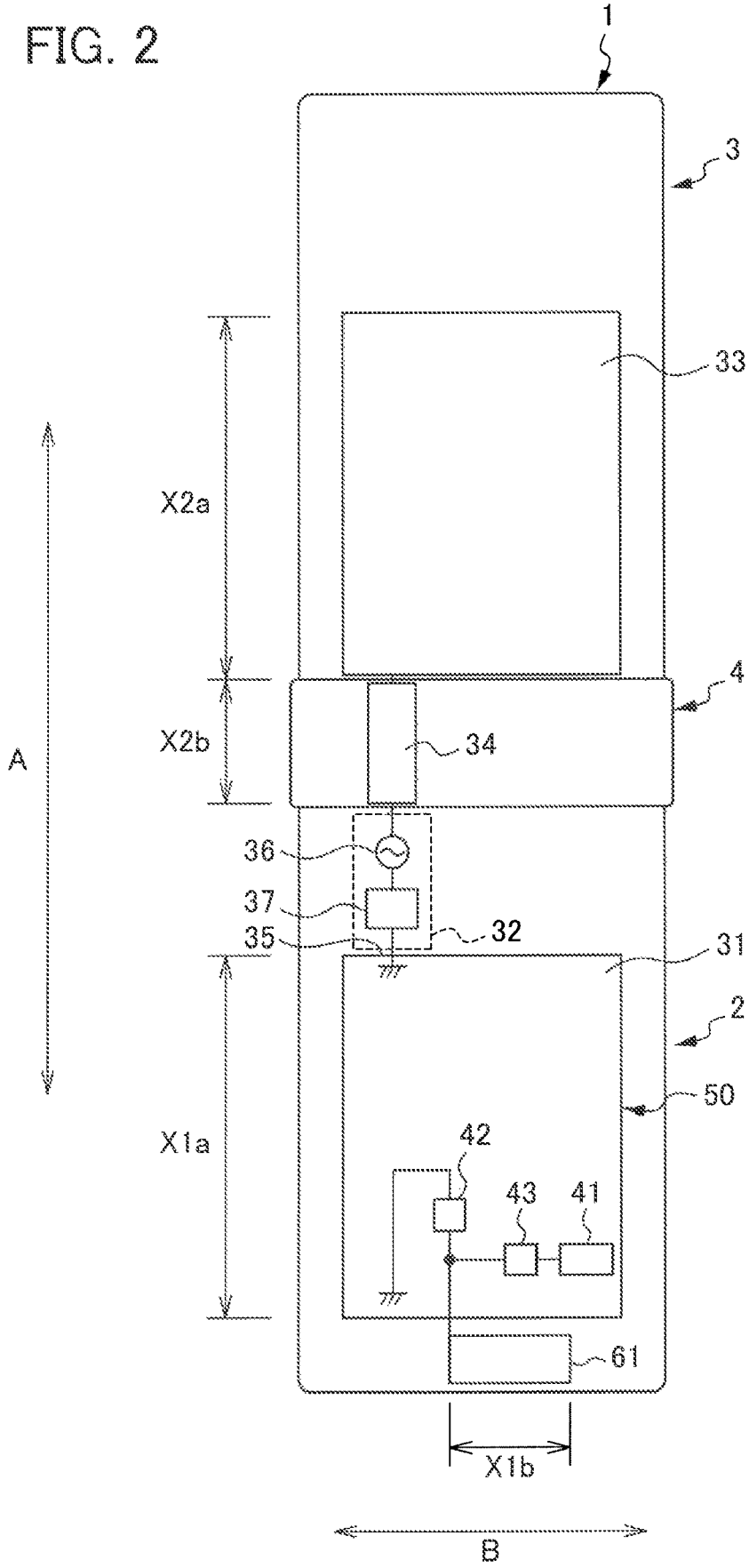
FIG. 2 is a front view schematically showing the opened state of the cellular telephone device in a first embodiment.
Figure 3:
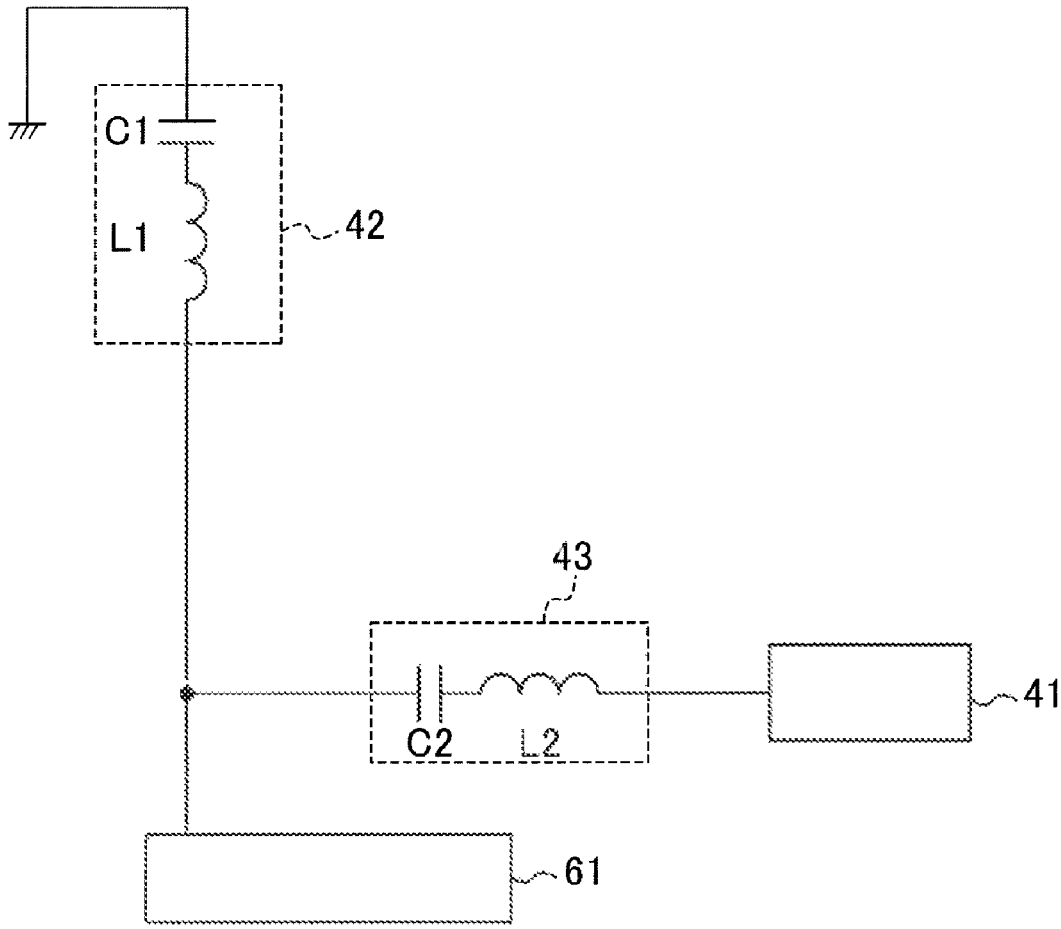
FIG. 3 is a circuit diagram showing a first suppression unit and a second suppression unit in the first embodiment.
Figure 4:
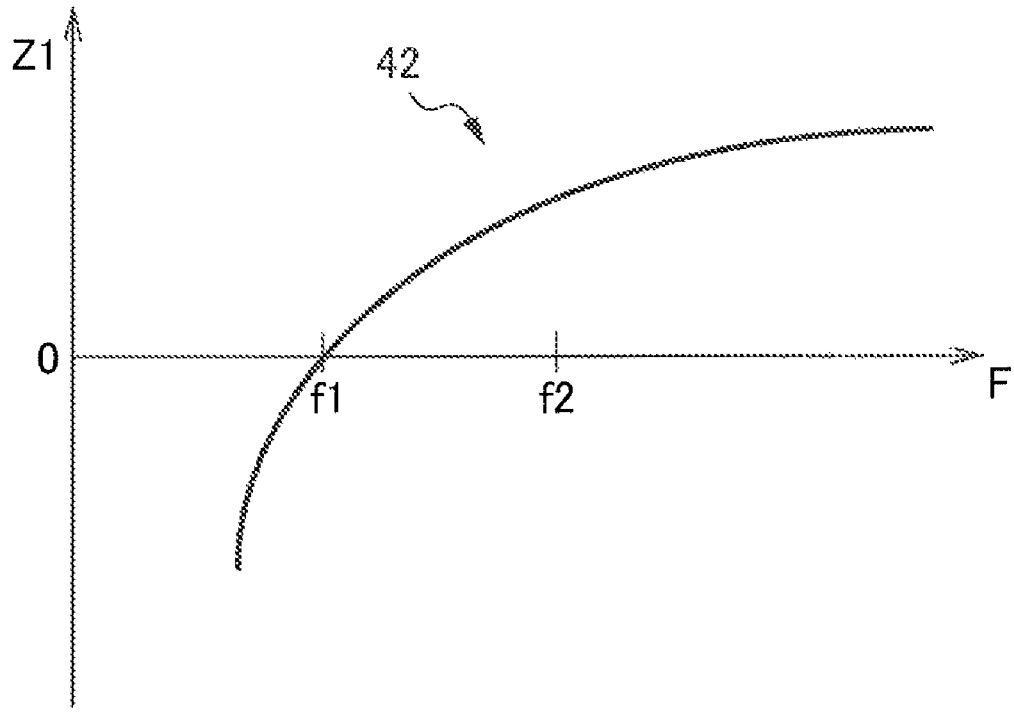
FIG. 4 is a graph showing electrical characteristics of the first suppression unit in the first embodiment.
Figure 5:
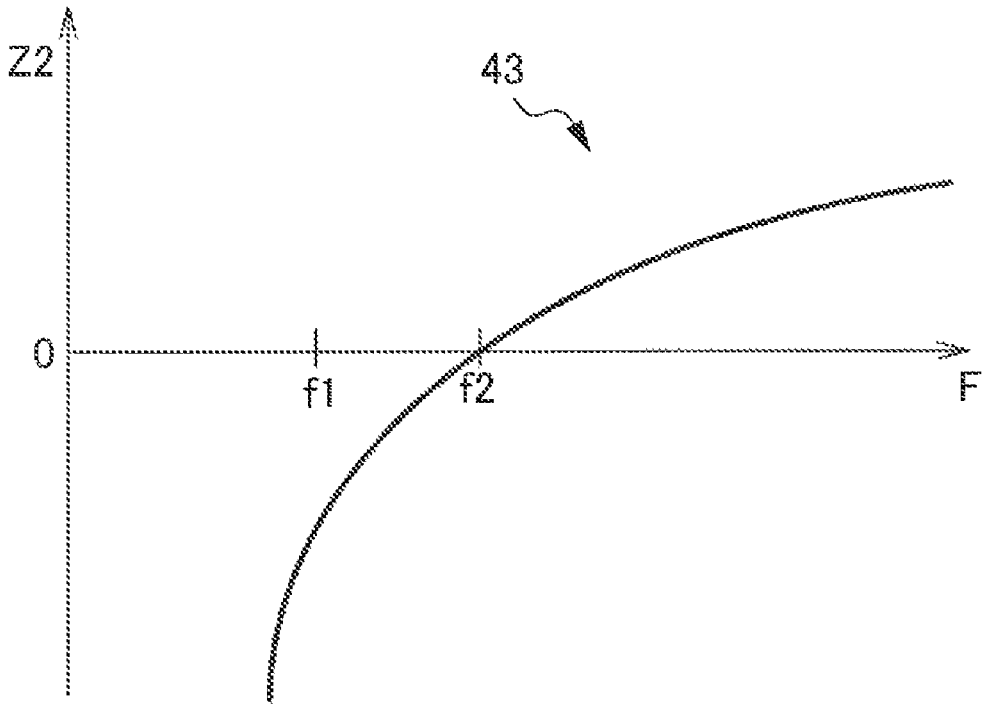
FIG. 5 is a graph showing electrical characteristics of the second suppression unit in the first embodiment.

Next, internal structures of the operation unit side body 2 and the display unit side body 3 are described with reference to FIGS. 2 to 5. FIG. 2 is a front view schematically showing the opened state of the cellular telephone device in the first embodiment. FIG. 3 is a circuit diagram showing a first suppression unit and a second suppression unit in the first embodiment. FIG. 4 is a graph showing electrical characteristics of the first suppression unit in the first embodiment. FIG. 5 is a graph showing electrical characteristics of the second suppression unit in the first embodiment.

It should be noted that, regarding components inside the operation unit side body 2, FIG. 2 only shows a first conductive portion 31, a first circuit unit 32, a second circuit unit 41, an antenna element 61 as a first electronic component, etc. Moreover, regarding components inside the display unit side body 3, FIG. 2 only shows a second conductive portion 33. In addition, regarding components inside the connecting portion 4, FIG. 2 only shows a third conductive portion 34. However, FIG. 2 does not limit each internal structure of the operation unit side body 2, the display unit side body 3 and the connecting portion 4.

Furthermore, as a virtual manner of illustration, FIG. 2 shows a connection state by way of a connecting wire(s) connecting the first conductive portion 31, the second conductive portion 33, the third conductive portion 34, the antenna element 61, the first circuit unit 32, the second circuit unit 41, etc. It should be noted that, in the present embodiment, the connecting wire(s) in FIG. 2 is illustrated for describing a connection state of each unit, and shall be excluded when describing a path length of a signal later, for convenience of explanation.

As shown in FIG. 2, the first conductive portion 31, the first circuit unit 32, the antenna element 61, the second circuit unit 41, the first suppression unit 42 and the second suppression unit 43 are included inside the operation unit side body 2, more specifically between the front case 2*a* and the rear case 2*b*.In the present embodiment, the first conductive portion 31, the second circuit unit 41, the first suppression unit 42 and the second suppression unit 43 are each disposed on the circuit board 50.

The first conductive portion 31 is a ground pattern formed on the circuit board 50. The first conductive portion 31 is formed so as to be elongated in the longitudinal direction A of the operation unit side body 2.

The first circuit unit 32 includes a ground unit 35, a power feed unit 36, and a signal processing unit 37 that is connected to the ground unit 35 and the power feed unit 36.

The ground unit 35 is connected to an end portion of the first conductive portion 31, on the connecting portion 4 side thereof in the longitudinal direction A. As a result, the ground unit 35 is connected at high frequency to the first conductive portion 31. The power feed unit 36 is connected at high frequency to the third conductive portion 34 disposed in the connecting portion 4. In addition, the ground unit 35 and the power feed unit 36 are disposed adjacently to each other in the first circuit unit 32. Moreover, the third conductive portion 34 is connected at high frequency to the second conductive portion 33 disposed in the display unit side body 3. In other words, the power feed unit 36 is connected so as to be capable of feeding power to the second conductive portion 33 and the third conductive portion 34. The power feed unit 36 is connected to the signal processing unit 37. The signal processing unit 37 is connected to the power feed unit 36, and performs processing of signals in a first frequency f1 band. In addition, the signal processing unit 37 is configured with: a radio circuit including an RF circuit; a matching circuit; a control circuit; and the like.

The antenna element 61 is disposed in an end portion (a lower end portion shown in FIG. 2) opposite to the connecting portion 4 in the operation unit side body 2. The antenna element 61 is disposed adjacently to the first conductive portion 31 in the longitudinal direction A of the operation unit side body 2.

The antenna element 61 is formed of a conductive material. The antenna element 61 is formed so as to be rectangular in a planar view, and is formed so as to be elongated in a direction B that is orthogonal to the longitudinal direction A of the operation unit side body 2. Here, the direction orthogonal to the longitudinal direction A of the operation unit side body 2 refers to a width direction B (a horizontal direction shown in FIG. 2) of the operation unit side body 2. Furthermore, the width direction B of the operation unit side body 2 coincides with a longitudinal direction of the antenna element 61. In this way, the antenna element 61 is disposed such that the longitudinal direction of the antenna element 61 is in parallel with the width direction B of the operation unit side body 2.

An end portion of the antenna element 61 in the longitudinal direction (the width direction B of the operation unit side body 2) is connected at high frequency to the first conductive portion 31. Moreover, the antenna element 61 is configured as an antenna element resonating with a signal in a second frequency f2 band, and functions as a radiating element of the antenna. It should be noted that the second frequency f2 band will be described later.

The second circuit unit 41 is connected at high frequency to the antenna element 61. The second circuit unit 41 processes signals in the second frequency f2 band that is resonated by the antenna element 61.

The first suppression unit 42 is disposed so as to be interposed between the first conductive portion 31 and the antenna element 61. The first conductive portion 31 is connected at high frequency to the antenna element 61 via the first suppression unit 42. The first suppression unit 42 suppresses signals in frequency bands different from the first frequency f1 band. In other words, the first suppression unit 42 allows passage of only signals in the first frequency f1 band, and suppresses passage of signals in other frequency bands. The first suppression unit 42 is configured such that the resonance frequency thereof is the first frequency f1 band.

As shown in FIG. 3, the first suppression unit 42 is configured with a first capacitor C1 and a first coil L1. The first frequency (resonance frequency) f1 is determined by the following equation (1), and impedance Z1 is determined by the following equation (2).

$$f1=\tfrac{1}{2}\pi\sqrt{(L1\ C1)} \tag{1}$$

$$Z1=j\omega L1+1/(j\omega C1) \tag{2}$$

where $\omega=2\pi f1$

As shown in FIG. 4, the first suppression unit 42 has characteristics obtained in a graph of impedance Z1, in which the resonance frequency thereof is the first frequency f1 band. In the first suppression unit 42, the impedance Z1 is 0Ω in the first frequency f1 band. In addition, in the first suppression unit 42, the impedance Z1 is inductive impedance or capacitive impedance in the other frequency bands. Accordingly, the first suppression unit 42 allows passage of signals in the first frequency f1 band, and functions as a bandpass filter that suppresses passage of signals in the other frequency bands. For example, in a case of CDMA (Code Division Multiple Access) communication that utilizes signals in an 800 MHz band as the first frequency f1 band, the first suppression unit 42 is configured with the first capacitor C1 and the first coil L1, in which the impedance Z1 is 0Ω in the 800 MHz band as the first frequency f1 band.

The first suppression unit 42 is disposed so as to be interposed between the first conductive portion 31 and the antenna element 61. Furthermore, in the first suppression unit 42, the impedance Z1 is 0Ω in the first frequency f1 band. Accordingly, the first suppression unit 42 allows passage of signals in the first frequency f1 band, and suppresses passage of signals in the other frequency bands. As a result, in the first suppression unit 42, the antenna element 61 is connected to the first conductive portion 31, in the first frequency f1 band. In this way, the antenna element 61 is connected to the ground unit 35 of the first circuit unit 32 via the first conductive portion 31 as a ground pattern.

Moreover, the second suppression unit 43 is disposed so as to be interposed between the antenna element 61 and the second circuit unit 41. The antenna element 61 is connected at high frequency to the second circuit unit 41 via the second suppression unit 43. The second suppression unit 43 suppresses passage of signals in frequency bands different from the second frequency f2 band. In other words, the second suppression unit 43 allows passage of signals in the second frequency f2 band, and suppresses passage of signals in the other frequency bands. The second suppression unit 43 is configured such that the resonance frequency thereof is the second frequency f2 band.

More specifically, as shown in FIG. 3, the second suppression unit 43 is configured with a second capacitor C2 and a second coil L2. The second frequency (resonance frequency) f2 is determined by the following equation (3).

$$f2=\tfrac{1}{2}\pi\sqrt{(L2\ C2)} \tag{3}$$

In addition, impedance Z2 is determined by the following equation (4).

$$Z2=j\omega L2+1/(j\omega C2) \tag{4}$$

where $\omega=2\pi f2$

Accordingly, as shown in FIG. 5, the second suppression unit 43 has characteristics obtained in a graph of impedance Z2, in which the resonance frequency is the second frequency f2 band. In other words, in the second suppression unit 43, the impedance Z2 is 0Ω in the second frequency f2 band. Furthermore, in the second suppression unit 43, the impedance Z2 is inductive impedance or capacitive impedance in the other frequency bands. Accordingly, the second suppression unit 43 allows passage of signals in the second frequency f2 band, and functions as a bandpass filter that suppresses passage of signals in the other frequency bands. For example, in a case of GPS (Global Positioning System) communication that utilizes signals in a 1575 MHz band as the second frequency f2 band, the second suppression unit 43 is configured with the second capacitor C2 and the second coil L2, in which the impedance Z2 is 0Ω in the 1575 MHz band as the second frequency f2 band.

As shown in FIGS. 2 to. 5, the second suppression unit 43 is disposed so as to be interposed between the antenna element 61 and the second circuit unit 41. Moreover, in the second suppression unit 43, the impedance Z2 is 0Ω in the second frequency f2 band. Accordingly, the second suppression unit 43 allows passage of signals in the second frequency f2 band, and suppresses passage of signals in the other frequency bands. As a result, in the second suppression unit 43, the antenna element 61 is connected at high frequency to the second conductive portion 41 in the second frequency f2 band.

In addition, as shown in FIG. 2, the second conductive portion 33 is a ground pattern formed on the circuit board disposed inside the display unit side body 3. The second conductive portion 33 is formed so as to be elongated in the longitudinal direction A of the display unit side body 3.

Furthermore, the third conductive portion 34 is configured with a conductive portion disposed inside the connecting portion 4. The third conductive portion 34 is formed so as to be elongated in the longitudinal direction A of the display unit side body 3. The third conductive portion 34 is disposed on an end portion side in the direction B, which is orthogonal to the longitudinal direction A of the display unit side body 3 in the connecting portion 4, in parallel with the longitudinal direction A of the display unit side body 3. The end portion of the third conductive portion 34 on the display unit side body 3 side is connected to the end portion in the longitudinal direction A of the second conductive portion 33. The end portion of the third conductive portion 34 on the operation unit side body 2 side is connected to the power feed unit 36 of the first circuit unit 32. As a result, the third conductive portion 34 is connected at high frequency to the second conductive portion 33, and is also connected at high frequency to the power feed unit 36 of the first circuit unit 32.

In the cellular telephone device 1 in the first embodiment described above, a first length X1 (X1*a*+X1*b*), which is obtained by summation of a length X1*a* (a path length of a signal in the first frequency f1 band) of the first conductive portion 31 in the longitudinal direction A of the operation unit side body 2 and a length X1*b* (a path length of a signal in the first frequency f1 band) of the antenna element 61 in the longitudinal direction (the width direction B of the operation unit side body 2), is substantially equal to a second length X2 (X2*a*+X2*b*), which is obtained by summation of a length X2*a* (a path length of a signal in the first frequency f1 band) of the second conductive portion 33 in the longitudinal direction A of the display unit side body 3 and a length X2*b* (a path length of a signal in the first frequency f1 band) of the third conductive portion 34 in the longitudinal direction A of the display unit side body 3 (X1=X2) (see FIG. 2).

Here, the first length X1 (X1*a*+X1*b*) is described in detail.

As shown in FIG. 2, the length X1*a* (a path length of a signal in the first frequency f1 band) of the first conductive portion 31 in the longitudinal direction A of the operation unit side body 2 is a path length in the first conductive portion 31 along the longitudinal direction A of the operation unit side body 2, and is a path length of a signal in the first frequency f1 band from an end portion of the first conductive portion 31 on the connecting portion 4 side to the other end portion thereof on the opposite side from the connecting portion 4. Moreover, the length X1*b* (a path length of a signal in the first frequency f1 band) of the antenna element 61 in the longitudinal direction (the width direction B of the operation unit side body 2) is a path length in the antenna element 61 along the longitudinal direction (the width direction B of the operation unit side body 2), and is a path length of a signal in the first frequency f1 band from one end portion of the antenna element 61 to the other end portion thereof.

In other words, the first length X1 (X1*a*+X1*b*) is a path length of a signal in the first frequency f1 band from a contact point, where the first conductive portion 31 is in contact with the ground unit 35, to the antenna element 61.

In addition, the second length X2 (X2*a*+X2*b*) is described in detail.

The length X2*a* (a path length of a signal in the first frequency f1 band) of the second conductive portion 33 in the longitudinal direction A of the display unit side body 3 is a path length in the second conductive portion 33 along the longitudinal direction A of the display unit side body 3, and is a path length of a signal in the first frequency f1 band from an end portion of the second conductive portion 33 on the connecting portion 4 side to the other end portion thereof on the opposite side from the connecting portion 4. Furthermore, the length X2*b* (a path length of a signal in the first frequency f1 band) of the third conductive portion 34 in the longitudinal direction A of the display unit side body 3 is a path length in the third conductive portion 34 along the longitudinal direction A of the display unit side body 3, and is a path length of a signal in the first frequency f1 band from an end portion of the third conductive portion 34 on the display unit side body 3 side to the other end portion thereof on the operation unit side body 2 side.

In other words, the second length X2 (X2*a*+X2*b*) is a path length of a signal in the first frequency f1 band from a contact point, where the third conductive portion 34 is in contact with the power feed unit 36, to the second conductive portion 33.

Moreover, the second conductive portion 33 in the display unit side body 3 and the third conductive portion 34 in the connecting portion 4 are electrically connected to the power feed unit 36. Accordingly, the second conductive portion 33 and the connecting portion 4 function as a radiating element of the antenna. In the operation unit side body 2, the first conductive portion 31 and the antenna element 61 are electrically connected to the ground unit 35. As a result, the first conductive portion 31 and the antenna element 61 function as a ground unit of the antenna. Therefore, the entirety of the display unit side body 3, the operation unit side body 2 and the connecting portion 4 configures a single antenna (for example, a dipole antenna).

Here, descriptions are provided for operations in the cellular telephone device 1 of the first embodiment.

First, with reference to FIGS. 2 to 5, descriptions are provided for a case in which a signal in the first frequency f1 band is input into the cellular telephone device 1.

As shown in FIGS. 2 to 5, in a case in which a signal in the first frequency f1 band is input into the cellular telephone device 1, the first suppression unit 42 allows passage of the signal in the first frequency f1 band. In other words, the first conductive portion 31 is connected at high frequency to the antenna element 61. Accordingly, since the first conductive portion 31 is electrically connected to the ground unit 35, the first conductive portion 31 and the antenna element 61 function as a ground unit of the antenna. In addition, the second conductive portion 33 and the third conductive portion 34 function as a radiating element of the antenna. On the other hand, the second suppression unit 43 suppresses passage of signals in frequency bands different from the second frequency f2 band. Accordingly, the second suppression unit 43 suppresses passage of signals in the first frequency f1 band. In other words, in the first frequency f1 band, the antenna element 61 is unlikely to be connected at high frequency to the second circuit unit 41.

In addition, the signal processing unit 37 of the first circuit unit 32 performs predetermined processing on signals in the first frequency f1 band fed from the power feed unit 36.

In this way, the entirety of the display unit side body 3 and the operation unit side body 2 configures a single antenna (for example, a dipole antenna).

Next, descriptions are provided for a case in which a signal in the second frequency f2 band is input into the cellular telephone device 1.

As shown in FIGS. 2 to 5, in a case in which a signal in the second frequency f2 band is input into the cellular telephone device 1, the first suppression unit 42 suppresses passage of signals in frequency bands different from the first frequency f1 band. Accordingly, the first suppression unit 42 suppresses passage of signals in the second frequency f2 band. In other words, in the second frequency f2 band, the antenna element 61 is unlikely to be connected at high frequency to the first circuit unit 42. Therefore, since the antenna element 61 is connected to the second circuit unit 41, the antenna element 61 functions as a radiating element of the antenna. On the other hand, the second suppression unit 43 allows passage of signals in the second frequency f2 band. In other words, in the second frequency f2 band, the antenna element 61 is connected at high frequency to the second circuit unit 41. In addition, the second circuit unit 41 connected to the antenna element 61 performs predetermined processing on signals in the second frequency f2 band that is resonated by the antenna element 61.

In this way, the antenna element 61 configures an antenna. According to the cellular telephone device 1 of the first embodiment described above, the following effects are achieved.

In the cellular telephone device 1, the first conductive portion 31 and the antenna element 61 of the operation unit side body 2 are connected to the ground unit 35 of the first circuit unit 32, and the second conductive portion 33 of the display unit side body 3 and the third conductive portion 34 of the connecting portion 4 are connected at high frequency to the power feed unit 36. Accordingly, the entirety of the operation unit side body 2, the display unit side body 3 and the connecting portion 4 configures a single antenna (for example, a dipole antenna). As a result, the antenna sensitivity of the cellular telephone device 1 can be improved.

Furthermore, the cellular telephone device 1 is configured such that the first circuit unit 32 and the antenna element 61 are disposed in the operation unit side body 2. Accordingly, the length for functioning as a radiating element of the antenna and the length for functioning as a ground unit of the antenna can be favorably balanced. As a result, the antenna sensitivity of the cellular telephone device 1 can be improved.

Moreover, a configuration is employed (X1=X2) such that the first length X1 (X1*a*+X1*b*), which is obtained by summation of the length X1*a* of the first conductive portion 31 in the longitudinal direction A of the operation unit side body 2 and the length X1*b* of the antenna element 61 in the longitudinal direction (the width direction B of the operation unit side body 2), is substantially equal to the second length X2 (X2*a*+X2*b*), which is obtained by summation of the length X2*a* of the second conductive portion 33 in the longitudinal direction A of the display unit side body 3 and the length X2*b* of the third conductive portion 34 in the longitudinal direction A of the display unit side body 3. As a result, the length for functioning as a radiating element of the antenna is substantially equal to the length for functioning as a ground unit of the antenna. Therefore, it is possible to improve the antenna sensitivity of the antenna (for example, a dipole antenna) configured with the entirety of the operation unit side body 2, the display unit side body 3 and the connecting portion 4.

In addition, the cellular telephone device 1 includes the first suppression unit 42 and the second suppression unit 43. Accordingly, in a case of using an antenna configured with the entirety of the operation unit side body 2, the display unit side body 3 and the connecting portion 4, in which the antenna element 61 serves as a part of the components, and in a case of using the antenna element 61 as an antenna, the antenna can function as an antenna compatible with frequency bands corresponding to signals in different frequency bands, respectively. More specifically, in a case in which the antenna element 61 is used as a shared antenna compatible with a plurality of frequency bands, the first suppression unit 42 and the second suppression unit 43 make it possible to cause the antenna to function as an antenna (for example, a dipole antenna) configured with the entirety of the operation unit side body 2, the display unit side body 3 and the connecting portion 4, or as an antenna (for example, a GPS antenna) in which the antenna element functions as an antenna radiating element. The first suppression unit 42 and the second suppression unit 43 contribute to so-called multiband compatibility of the cellular telephone device 1.

Figure 6:
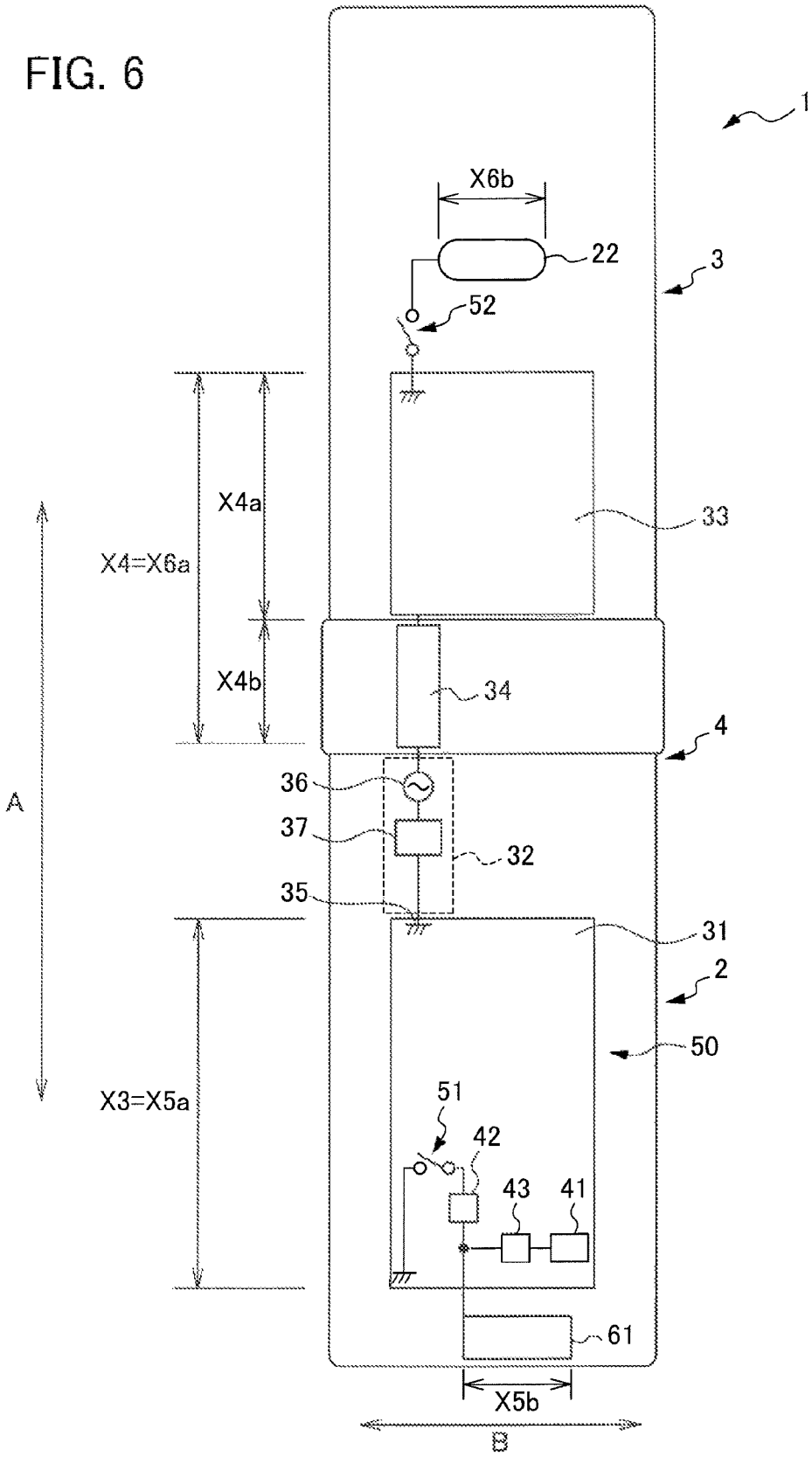
FIG. 6 is a front view schematically showing an opened state of a cellular telephone device in a second embodiment.
Figure 7:
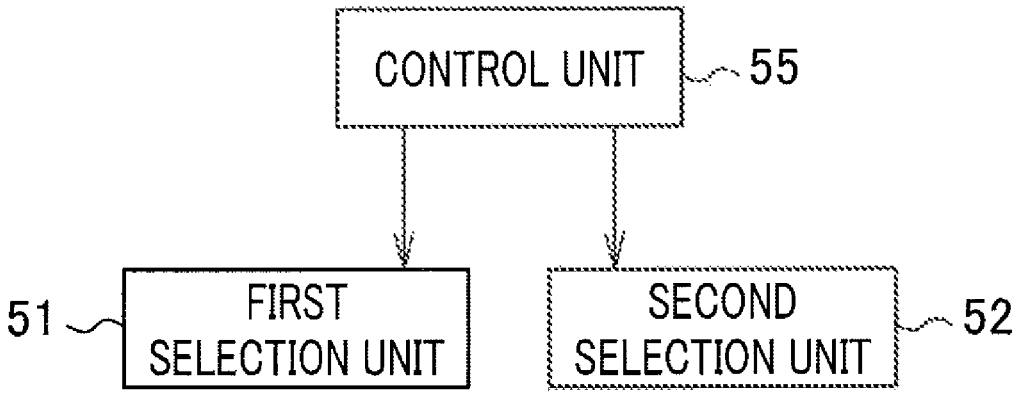
FIG. 7 is a block diagram showing a configuration of control of the cellular telephone device in the second embodiment.

Next, descriptions are provided for the cellular telephone device 1 according to a second embodiment with reference to FIGS. 6 and 7. FIG. 6 is a front view schematically showing an opened state of the cellular telephone device in the second embodiment. FIG. 7 is a block diagram showing a configuration of control of the cellular telephone device in the second embodiment. As a virtual manner of illustration, regarding components inside the operation unit side body 2, FIG. 6 only shows the first conductive portion 31, the first circuit unit 32, the antenna element 61, a first selection unit 51, etc. Furthermore, regarding components inside the display unit side body 3, only the second conductive portion 33, a second selection unit 52, a receiver 22, etc. are shown. Moreover, regarding an internal structure of the connecting portion 4, only the third conductive portion 34 is shown. However, FIGS. 6 and 7 do not limit each internal structure of the operation unit side body 2, the display unit side body 3 and the connecting portion 4.

In addition, as a virtual manner of illustration, FIG. 6 shows a connection state by way of a connecting wire(s)connecting the first conductive portion 31, the second conductive portion 33, the third conductive portion 34, the antenna element 61, the receiver 22, the first circuit unit 32, the second circuit unit 41, etc. It should be noted that, in the present embodiment, the connecting wire(s) in FIG. 6 is shown for describing a connection state of each unit, and shall be excluded when describing a path length of a signal later, for convenience of explanation.

The cellular telephone device 1 in the second embodiment has a configuration similar to that of the cellular telephone device 1 in the first embodiment, except for including the receiver 22 as a second electronic component, the first selection unit 51, and the second selection unit 52, and except for the proportion of each length of the first conductive portion 31, the second conductive portion 33 and the third conductive portion 34. Therefore, the second embodiment is mainly described with regard to the receiver 22, the first selection unit 51 and the second selection unit 52, as well as the proportion of each length of the first conductive portion 31, the second conductive portion 33 and the third conductive portion 34; and descriptions of other components are omitted.

As shown in FIGS. 6 and 7, the cellular telephone device 1 includes the receiver 22, the first selection unit 51, the second selection unit 52, and the control unit 55. It should be noted that the control unit 55 is included in the signal processing unit 37.

The receiver 22 and the second selection unit 52 are disposed inside the display unit side body 3. The second selection unit 52 is disposed on the circuit board. The first selection unit 51 is disposed on the circuit board 50 inside the operation unit side body 2.

The receiver 22 is disposed to an end side (an upper side shown in FIG. 6) that is opposite to the connecting portion 4 in the display unit side body 3. The receiver 22 is disposed adjacently to the second conductive portion 33 in the longitudinal direction A of the display unit side body 3.

The receiver 22 is formed of a metallic conductive material. The receiver 22 is formed so as to be substantially oval in a planar view. Furthermore, the receiver 22 is formed so as to be elongated in the direction B that is orthogonal to the longitudinal direction A of the display unit side body 3. Here, the direction B orthogonal to the longitudinal direction A of the display unit side body 3 refers to the width direction B (the horizontal direction shown in FIG. 6) of the display unit side body 3. Moreover, the width direction B of the display unit side body 3 coincides with the longitudinal direction of the receiver 22. In this way, the receiver 22 is disposed such that the longitudinal direction of the receiver 22 is in parallel with the width direction B of the display unit side body 3.

In addition, an end portion of the receiver 22 in the longitudinal direction of the receiver 22 (the width direction B of the display unit side body 3) is connected at high frequency to the conductive portion 33.

The first selection unit 51 selectively makes changes between a state where the first conductive portion 31 and the antenna element 61 are connected at high frequency, and a state where the first conductive portion 31 and the antenna element 61 are cut off at high frequency. The second selection unit 52 selectively makes changes between a state where the second conductive portion 33 and the receiver 22 are connected at high frequency, and a state where the second conductive portion 33 and the receiver 22 are cut off at high frequency.

As shown in FIG. 7, the control unit 55 controls connection or cutoff of the first selection unit 51, and controls connection or cutoff of the second selection unit 52.

Here, with reference to FIGS. 6 and 7, descriptions are provided for control of the first selection unit 51 and the second selection unit 52 by the control unit 55.

As shown in FIG. 7, the control unit 55 can switch between a first state in which both the first selection unit 51 and the second selection unit 52 select a cutting off state, and a second state in which both the first selection unit 51 and the second selection unit 52 select a connecting state.

In a state in which the control unit 55 has switched to the first state, the first conductive portion 31 functions as a ground unit of the antenna. Furthermore, the second conductive portion 33 and the third conductive portion 34 integrally function as a radiating element of the antenna.

In this case, a third length X3 (a path length of a signal in the first frequency f1 band) of the first conductive portion 31 in the longitudinal direction A of the operation unit side body 2 is substantially equal to a fourth length X4 (X4*a*+X4*b*) that is obtained by summation of a length X4*a* (a path length of a signal in the first frequency f1 band) of the second conductive portion 33 in the longitudinal direction A of the display unit side body 3 and a length X4*b* (a path length of a signal in the first frequency f1 band) of the third conductive portion 34 in the longitudinal direction A of the display unit side body 3 (X3=X4). Accordingly, the fourth length X4, which is obtained by summation of the length X4*a* of the second conductive portion 33 that functions as a radiating element of the antenna and the length X4*b* of the third conductive portion 34, is substantially equal to the third length X3 of the first conductive portion 31 that functions as a ground unit of the antenna.

Here, the third length X3 is described in detail. As shown in FIG. 6, the third length X3 (a path length of a signal in the first frequency f1 band) of the first conductive portion 31 in the longitudinal direction A of the operation unit side body 2 is a path length in the first conductive portion 31 along the longitudinal direction A of the operation unit side body 2, and is a path length of a signal in the first frequency f1 band from an end portion of the first conductive portion 31 on the connecting portion 4 side to the other end portion thereof on the opposite side from the connecting portion 4.

In other words, the third length X3 is a path length of a signal in the first frequency f1 band from a contact point, where the first conductive portion 31 is in contact with the ground unit 35, to a contact point, where the first conductive portion 31 is in contact with the antenna element 61.

Moreover, the fourth length X4 (X4*a*+X4*b*) is described in detail.

The length X4*a* (a path length of a signal in the first frequency f1 band) of the second conductive portion 33 in the longitudinal direction A of the display unit side body 3 is a path length in the second conductive portion 33 along the longitudinal direction A of the display unit side body 3, and is a path length of a signal in the first frequency f1 band from an end portion of the second conductive portion 33 on the connecting portion 4 side to the other end portion thereof on the opposite side from the connecting portion 4. In addition, the length X4*b* (a path length of a signal in the first frequency f1 band) of the third conductive portion 34 in the longitudinal direction A of the display unit side body 3 is a path length in the third conductive portion 34 along the longitudinal direction A of the display unit side body 3, and is a path length of a signal in the first frequency f1 band from an end portion of the third conductive portion 34 on the display unit side body 3 side to the other end portion thereof on the operation unit side body 2 side.

In other words, the fourth length X4 (X4*a*+X4*b*) is a path length of a signal in the first frequency f1 band from a contact point, where the third conductive portion 34 is in contact with the power feed unit 36, to the second conductive portion 33.

In a state in which the control unit 55 has switched to the second state, the first conductive portion 31 and the antenna element 61 integrally function as a ground unit of the antenna. Furthermore, the receiver 22, the second conductive portion 33 and the third conductive portion 34 integrally function as a radiating element of the antenna.

In this case, connection is established such that a fifth length X5 (X3+X5*b*), which is obtained by summation of the third length X3 (X5*a* (a path length of a signal in the first frequency f1 band)) and a length X5*b* (a path length of a signal in the first frequency f1 band) of the antenna element 61 in the longitudinal direction (the width direction B of the operation unit side body 2), is substantially equal to a sixth length X6, which is obtained by summation of the fourth length X4 (X6*a* (a path length of a signal in the first frequency f1 band)) and a length X6*b* (a path length of a signal in the first frequency f1 band) of the receiver 22 in the longitudinal direction (the width direction B of the display unit side body 3) (X5=X6). Accordingly, the sixth length X6 (X4+X6*b*), which is obtained by summation of the fourth length X4 for functioning as a radiating element of the antenna and the length X6*b* of the receiver 22, is substantially equal to the fifth length X5, which is obtained by summation of the third length X3 for functioning as a ground unit of the antenna and the length X5*b* of the antenna element 61.

Here, the fifth length X5 (X3+X5*b*) is described in detail.

As described above, the third length X3 is a path length of a signal in the first frequency f1 band from the ground unit 35 to the first conductive portion 31. Moreover, the length X5*b* (a path length of a signal in the first frequency f1 band) of the antenna element 61 in the longitudinal direction (the width direction B of the operation unit side body 2) is a path length in the antenna element 61 along the longitudinal direction (the width direction B of the operation unit side body 2), and is a path length of a signal in the first frequency f1 band from one end portion of the antenna element 61 to the other end portion thereof.

In other words, the fifth length X5 (X3+X5*b*) is a path length of a signal in the first frequency f1 band from a contact point, where the first conductive portion 31 is in contact with the ground unit 35, to the antenna element 61.

In addition, the sixth length X6 (X4+X6*b*) is described in detail.

As described above, the fourth length X4 is a path length of a signal in the first frequency f1 band from the power feed unit 36 via the third conductive portion 34 to the second conductive portion 33. Furthermore, the length X6*b* (a path length of a signal in the first frequency f1 band) of the receiver 22 in the longitudinal direction (the width direction B of the display unit side body 3) is a path length in the receiver 22 along the longitudinal direction (the width direction B of the display unit side body 3), and is a path length of a signal in the first frequency f1 band from one end portion of the receiver 22 to the other end portion thereof.

In other words, the sixth length X6 (X4+X6*b*) is a path length of a signal in the first frequency f1 band from a contact point, where the third conductive portion 34 is in contact with the power feed unit 36, to the receiver 22.

According to the cellular telephone device 1 of the second embodiment described above, the following effects are achieved.

The control unit 55 controls the first selection unit 51 and the second selection unit 52. The control unit 55 is configured so as to be capable of switching between a connection state in which the third length X3 of the first conductive portion 31 in the longitudinal direction A of the operation unit side body 2 is substantially equal to the fourth length X4, which is obtained by summation of the length X4*a* of the second conductive portion 33 in the longitudinal direction A of the display unit side body 3 and the length X4*b* of the third conductive portion 34 in the longitudinal direction A of the display unit side body 3 (X3=X4), and a connection state in which the fifth length X5, which is obtained by summation of the third length X3 (X5*a*) and the length X5*b* of the antenna element 61 in the longitudinal direction (the width direction B of the operation unit side body 2), is substantially equal to the sixth length X6, which is obtained by summation of the fourth length X4 (X6*a*) and the length X6*b* of the receiver 22 in the longitudinal direction (the width direction B of display unit side body 3) (X5=X6).

Accordingly, the length for functioning as a radiating element of the antenna is substantially equal to the length for functioning as a ground unit of the antenna, in either cases of switching to the state in which the fifth length X5 is substantially equal to the sixth length X6 (X5=X6) or the state in which the third length X3 is substantially equal to the fourth length X4 (X3=X4). Therefore, it is possible to improve the antenna sensitivity of the antenna (for example, a dipole antenna) configured with the entirety of the operation unit side body 2 and the display unit side body 3.

Moreover, the fifth length X5 and the sixth length X6 (X5=X6) are configured so as to be longer than the third length X3 and the fourth length X4 (X3=X4), respectively (X3=X4<X5=X6). Accordingly, it is possible to establish compatibility with not only frequencies used in the third length X3 and the fourth length X4, but also with frequencies used in the fifth length X5 and the sixth length X6. More specifically, in a case in which the fifth length X5 and the sixth length X6 are configured so as to be longer than the third length X3 and the fourth length X4 (X3=X4<X5=X6), respectively, the fifth length X5 and the sixth length X6 are lengths for functioning as a radiating element of the antenna that is compatible with frequencies lower than the frequencies that the third length X3 and the fourth length X4 are compatible with. Therefore, the cellular telephone device 1 can be made compatible with different frequencies only by the control unit 55 controlling the first selection unit 51 and the second selection unit 52.

Although the preferable embodiments have been described above, the present invention is not limited to the aforementioned embodiments, and can be implemented as various embodiments.

For example, although the present embodiment is configured such that the first conductive portion 31 is connected to the ground unit 35 of the first circuit unit 32, and the third conductive portion 34 is connected to the power feed unit 36 of the first circuit unit 32, it may be configured such that the first conductive portion 31 is connected to the power feed unit 36 of the first circuit unit 32, and the third conductive portion 34 is connected to the ground unit 35 of the first circuit unit 32.

In addition, although the receiver 22 is used as the second electronic component that is connected to the second conductive portion 33 in the present embodiment, the present invention is not limited thereto. In other words, a microphone, IrDA (Infrared Data Association), a camera, an external connector or the like may be used as the electronic component.

Furthermore, although the first conductive portion 31 and the second conductive portion 33 are configured with the circuit board in the present embodiment, the present invention is not limited thereto. In other words, the first conductive portion 31 and the second conductive portion 33 may be configured with a shielding case or the like. Moreover, the path lengths of signals in the first frequency f1 band or the second frequency f2 band may appropriately vary depending on the position of the contact point where the power feed unit 36 or the ground unit 35 is in contact with any of the conductive portions, or the shapes of the conductive portions; and the present embodiment merely represents one aspect of the invention. In other words, the path lengths of signals in the first frequency f1 band or the second frequency f2 band can be appropriately changed by changing the position of the contact point where the power feed unit 36 or the ground unit 35 is in contact with any of the conductive portions, or the shape of the conductive portions, in accordance with design.

In the cellular telephone device 1 of the present embodiment, the first frequency f1 band is for signals in a frequency band utilized for CDMA (Code Division Multiple Access) communication, and the second frequency f2 band is for signals in a frequency band utilized for GPS (Global Positioning System) communication; however, it is not limited thereto. For example, it is possible to establish compatibility with signals of terrestrial digital broadcasting, signals of wireless LAN, signals of RFID, etc.

In addition, although the present invention is applied to the cellular telephone device 1 as a mobile terminal device in the present embodiment, it is not limited thereto. In other words, the present invention may be applied to a mobile terminal device such as a PHS (Personal Handyphone System), a PDA (Personal Digital Assistant), a portable navigation device, a notebook PC or the like.

The invention claimed is:

1. A mobile terminal device, comprising:

a first body;

a second body;

a connecting portion that connects the first body and the second body;

a first circuit unit that is disposed in the first body, and includes a ground unit, a power feed unit and a signal processing unit that is connected to the power feed unit and processes a signal in a first frequency band;

a first conductive portion that is disposed in the first body, and is connected to one of the ground unit or the power feed unit;

a second conductive portion that is disposed in the second body;

a third conductive portion that is disposed in the connecting portion, and is connected to the second conductive portion and the other one of the ground unit or the power feed unit; and a first electronic component that is disposed adjacently to the first conductive portion in the first body, and is connected at high frequency to the first conductive portion, wherein a first length, which is obtained by summation of a path length of a signal in the first frequency band in the first conductive portion and a path length of a signal in the first frequency band in the first electronic component, is substantially identical to a second length, which is obtained by summation of a path length of a signal in the first frequency band in the second conductive portion and a path length of a signal in the first frequency band in the third conductive portion.

2. The mobile terminal device according to claim 1, wherein the first conductive portion is connected to the ground unit, wherein the third conductive portion is connected to the power feed unit, wherein the first length is a path length of a signal in the first frequency band from a contact point, where the first conductive portion is in contact with the ground unit, to the first electronic component, and wherein the second length is a path length of a signal in the first frequency band from a contact point, where the third conductive portion is in contact with the power feed unit, to the second conductive portion.

3. The mobile terminal device according to claim 1, wherein the first conductive portion is formed so as to be elongated in a longitudinal direction of the first body, wherein the second conductive portion is formed so as to be elongated in a longitudinal direction of the second body, and wherein the first electronic component is formed so as to be elongated in a width direction that is orthogonal to the longitudinal direction of the first body, and one end of the first electronic component in the width direction is connected to the first conductive portion.

4. The mobile terminal device according to claim 1, wherein the first electronic component is an antenna element resonating with a signal in a second frequency band, the mobile terminal device further comprising:

a second circuit unit that is connected to the first electronic component, and processes a signal in the second frequency band resonated by the first electronic component;

a first suppression unit that is disposed so as to be interposed between the first conductive portion and the first electronic component, and suppresses passage of a signal in a frequency band different from the first frequency band; and a second suppression unit that is disposed so as to be interposed between the first electronic component and the second circuit unit, and suppresses passage of a signal in a frequency band different from the second frequency band.

5. The mobile terminal device according to claim 1, further comprising:

a second electronic component that is disposed adjacently to the second conductive portion in the longitudinal direction of the second body in the second body, and is connected at high frequency to the second conductive portion;

a first selection unit that is configured so as to be capable of selecting a state where the first conductive portion and the first electronic component are connected at high frequency, or a state where the first conductive portion and the first electronic component are cut off at high frequency;

a second selection unit that is configured so as to be capable of selecting a state where the second conductive portion and the second electronic component are connected at high frequency, or a state where the second conductive portion and the second electronic component are cut off at high frequency; and a control unit that controls connection or cutoff of the first selection unit, and connection or cutoff of the second selection unit.

6. A mobile terminal device, comprising:

a first body;

a second body;

a connecting portion that connects the first body and the second body;

a first circuit unit that is disposed in the first body, and includes a ground unit, a power feed unit and a signal processing unit that is connected to the power feed unit and processes a signal in a first frequency band;

a first conductive portion that is disposed in the first body, and is connected to one of the ground unit or the power feed unit;

a second conductive portion that is disposed in the second body;

a third conductive portion that is disposed in the connecting portion, and is connected to the second conductive portion and the other one of the ground unit or the power feed unit; and a first electronic component that is disposed adjacently to the first conductive portion in the longitudinal direction of the first body in the first body, and is connected at high frequency to the first conductive portion; and a second electronic component that is disposed adjacently to the second conductive portion in the longitudinal direction of the second body in the second body, and is connected at high frequency to the second conductive portion, wherein a third length, which is a path length of a signal in the first frequency band in the first conductive portion, is substantially identical to a fourth length, which is obtained by summation of a path length of a signal in the first frequency band in the second conductive portion and a path length of a signal in the first frequency band in the third conductive portion, and wherein a fifth length, which is obtained by summation of the third length and a length along a longitudinal direction of the first electronic component, is substantially identical to a sixth length, which is obtained by summation of the fourth length and a length along a longitudinal direction of the second electronic component.

7. The mobile terminal device according to claim 6, wherein the first conductive portion is connected to the ground unit, wherein the third conductive portion is connected to the power feed unit, wherein the third length is a path length of a signal in the first frequency band from a contact point, where the first conductive portion is in contact with the ground unit, to a contact point, where the first conductive portion is in contact with the first electronic component, wherein the fourth length is a path length of a signal in the first frequency band from a contact point, where the third conductive portion is in contact with the power feed unit, to the second conductive portion, wherein the fifth length is a path length of a signal in the first frequency band from a contact point, where the first conductive portion is in contact with the ground unit, to the first electronic component, and wherein the sixth length is a path length of a signal in the first frequency band from a contact point, where the third conductive portion is in contact with the power feed unit, to the second electronic component.

8. The mobile terminal device according to claim 6, wherein the first conductive portion is formed so as to be elongated in a longitudinal direction of the first body, wherein the second conductive portion is formed so as to be elongated in a longitudinal direction of the second body, wherein the first electronic component is formed so as to be elongated in a width direction that is orthogonal to the longitudinal direction of the first body, and one end of the first electronic component in the width direction of the first body is connected to the first conductive portion, and wherein the second electronic component is formed so as to be elongated in a width direction that is orthogonal to the longitudinal direction of the second body, and one end of the second electronic component in the width direction of the second body is connected to the second conductive portion.

9. The mobile terminal device according to claim 6, wherein the first electronic component is an antenna element resonating with a signal in a second frequency band, the mobile terminal device further comprising:

a second circuit unit that is connected to the first electronic component, and processes a signal in the second frequency band resonated by the first electronic component;

a first suppression unit that is disposed so as to be interposed between the first conductive portion and the first electronic component, and suppresses passage of a signal in a frequency band different from the first frequency band; and a second suppression unit that is disposed so as to be interposed between the first electronic component and the second circuit unit, and suppresses passage of a signal in a frequency band different from the second frequency band.

10. The mobile terminal device according to claim 6, further comprising:

a first selection unit that is configured so as to be capable of selecting a state where the first conductive portion and the first electronic component are connected at high frequency, or a state where the first conductive portion and the first electronic component are cut off at high frequency;

a second selection unit that is configured so as to be capable of selecting a state where the second conductive portion and the second electronic component are connected at high frequency, or a state where the second conductive portion and the second electronic component are cut off at high frequency; and a control unit that controls connection or cutoff of the first selection unit, and connection or cutoff of the second selection unit.

* * * * *